US011105031B2

(12) United States Patent
Xu et al.

(10) Patent No.: US 11,105,031 B2
(45) Date of Patent: Aug. 31, 2021

(54) WASHING MACHINE AND CONTROL METHOD THEREOF

(71) Applicant: QINGDAO HAIER DRUM WASHING MACHINE CO., LTD., Shandong (CN)

(72) Inventors: Sheng Xu, Shandong (CN); Yan Li, Shandong (CN); Mingyao Liu, Shandong (CN)

(73) Assignee: QINGDAO HAIER DRUM WASHING MACHINES CO., LTD., Shandong (CN)

( * ) Notice: Subject to any disclaimer, the term of this patent is extended or adjusted under 35 U.S.C. 154(b) by 283 days.

(21) Appl. No.: 16/066,929

(22) PCT Filed: Dec. 22, 2016

(86) PCT No.: PCT/CN2016/111422
§ 371 (c)(1),
(2) Date: Jun. 28, 2018

(87) PCT Pub. No.: WO2017/114270
PCT Pub. Date: Jul. 6, 2017

(65) Prior Publication Data

US 2019/0010649 A1 Jan. 10, 2019

(30) Foreign Application Priority Data

Dec. 31, 2015 (CN) ..... 201511029635.5

(51) Int. Cl.
*D06F 33/00* (2020.01)
*D06F 39/00* (2020.01)
*D06F 34/28* (2020.01)

(52) U.S. Cl.
CPC ..... *D06F 33/00* (2013.01); *D06F 34/28* (2020.02); *D06F 39/00* (2013.01);
(Continued)

(58) Field of Classification Search
None
See application file for complete search history.

(56) References Cited

U.S. PATENT DOCUMENTS

2013/0185079 A1* 7/2013 Park ..... G10L 15/26 704/275
2016/0326682 A1 11/2016 Sato et al.

FOREIGN PATENT DOCUMENTS

CN 102193511 A 9/2011
CN 102413208 A 4/2012
(Continued)

OTHER PUBLICATIONS

Translation of DE102012101537A1.*
(Continued)

*Primary Examiner* — Michael E Barr
*Assistant Examiner* — Jason P Riggleman
(74) *Attorney, Agent, or Firm* — Buchanan Ingersoll & Rooney PC

(57) ABSTRACT

A washing machine is provided with a control panel and is further provided with a connecting part of an intelligent terminal. The connecting part is in data connection with the intelligent terminal and is used for controlling the washing machine by the intelligent terminal. The control panel is of a panel structure which is not provided with a washing program control button, a display screen as well as a peripheral circuit for driving the display screen and the washing program control button. The washing machine is simple and generous in appearance, easy to operate, capable of greatly reducing the production cost and also saving manpower and material resources, and convenient to popularize.

12 Claims, 6 Drawing Sheets

(52) U.S. Cl.
CPC ..... *D06F 2202/12* (2013.01); *D06F 2212/02* (2013.01); *D06F 2216/00* (2013.01)

(56) References Cited

FOREIGN PATENT DOCUMENTS

| | | | | |
|---|---|---|---|---|
| CN | 102912589 | A | | 2/2013 |
| CN | 204039762 | U | | 12/2014 |
| DE | 10 2004 021 019 | A1 | | 11/2005 |
| DE | 102004021019 | | * | 11/2005 |
| DE | 10 2012 101 537 | A1 | | 8/2013 |
| DE | 102012101537 | A1 | * | 8/2013 |
| JP | H11-215219 | A | | 8/1999 |
| JP | 2002-273089 | A | | 9/2002 |
| JP | 2009-226060 | A | | 10/2009 |
| JP | 2015-136373 | A | | 7/2015 |
| KR | 2011-0126437 | A | | 11/2011 |

OTHER PUBLICATIONS

Translation of DE102004021019.*
*International Search Report (PCT/ISA/210) dated Mar. 28, 2017, by the Chinese Patent Office as the International Searching Authority for International Application No. PCT/CN2016/111422.
Extended European Search Report dated Dec. 14, 2018, issued by the European Patent Office in corresponding European Application No. 16881059.6. (7 pages).
Office Action (Notification of Reason for Refusal) dated Oct. 29, 2019, by the Korean Patent Office in corresponding Korean Patent Application No. 10-2018-7021033 and English translation of the Office Action. (9 pages).
Office Action (Notification of Reasons for Refusal) dated Dec. 3, 2019, by the Japanese Patent Office in corresponding Japanese Patent Application No. 2018-534733 and English translation of the Office Action. (10 pages).

* cited by examiner

WASHING MACHINE AND CONTROL METHOD THEREOF

TECHNICAL FIELD

The present disclosure relates to the field of washing of washing machines and in particular relates to a washing machine and a control method thereof.

BACKGROUND

With the development of Internet, intelligent household electrical appliances also rapidly rise, the household electrical appliances can actively perceive self-states, surrounding environment states and the like by utilizing a microprocessor, a sensor technology and a network communication technology and can automatically control or receive remote control instructions. Further, the intelligent household electrical appliances can partially or wholly substitute people to finish tasks, or finish tasks that cannot be finished by human beings, and the intelligent household electrical appliances have sensitive perceptibility, correct thinking ability, accurate judgment and effective executive capability.

The intelligent household electrical appliances are gradually improved in capability and are also higher and higher in requirement for input capability. Illustrated by an example of an intelligent washing machine, some washing machines adopt button input as the unique input way and are provided with one or several LED windows to display current states; some washing machines display the current states by using miniature screens with three primary colors or a plurality of primary colors and realize input by using fake touch buttons. Nowadays, with of the rise of the miniature screens, 7-inch TFT tough screens appear on some intelligent washing machines to realize state display and input and meet requirements of most of intelligent washing machines for input, such as configuration of networking modules and help for program use; and some intelligent washing machines break through inherent washing programs and finish washing by freely combining washing parameters.

However, the rapid development of display and input ways of the intelligent washing machines also brings a series of adverse effects, for example, the increment of a series of costs such as the self cost of 7-inch TFT screens, the cost of peripheral circuits for driving display screens and the cost of developers invested for display devices, and therefore, the intelligent washing machine cannot be popularized.

Therefore, an intelligent washing machine which is not only capable of finishing various functions of the intelligent washing machine, but also capable of greatly reducing the cost and convenient to popularize is needed urgently.

For this purpose, the intelligent washing machine is provided.

SUMMARY

The technical problem to be solved by the present disclosure is to provide a washing machine to overcome defects in the prior art. A control panel of the washing machine is not needed to be provided with washing program control buttons, a display screen as well as peripheral circuits for driving the display screen and the washing program control buttons, but the washing machine is provided with a connecting part of an intelligent terminal, the connecting part is used for connecting the intelligent terminal and the washing machine and controlling the washing machine. A control center of the intelligent terminal is artfully used as a control center of the washing machine, and the display screen of the intelligent terminal is used as the display screen of the washing machine, so that the production cost as well as the research and development costs of the washing machine are greatly reduced. Due to the adoption of the intelligent terminal, the upgrade and update of the washing machine can also be realized, and the intelligent terminal is convenient to operate and beneficial to the popularization and use of the washing machine.

Another aim of the present disclosure is to provide a control method for the washing machine.

A technical solution adopted for solving the technical problems is that:

a washing machine is provided, the washing machine is provided with a control panel and is further provided with a connecting part of an intelligent terminal, the connecting part can be in data connection with the intelligent terminal and can be used for controlling the washing machine by the intelligent terminal, and the control panel is of a panel structure which is not provided with washing program control buttons, a display screen as well as peripheral circuits for driving the display screen and the washing program control buttons.

Further, the connecting part is a media interface which is connected with a serial interface in the washing machine by a chip for converting the serial interface into the media interface; and the chip for converting the serial interface into the media interface is arranged in a mainboard circuit of the washing machine.

Further, the media interface comprises a USB interface and/or a miniUSB interface.

Further, the connecting part is a serial interface on the washing machine, which is connected with an audio interface on the intelligent terminal by a data line.

Further, the control panel is provided with a power button and a start/pause button; when the washing machine is not connected with the intelligent terminal, a washing program which is defaulted to be started by the start/pause button is:

a washing program defaulted in the washing machine; or a washing program preset by the intelligent terminal; or a historical washing program most frequently executed by the washing machine; or a washing program executed by the washing machine for the last time.

Further, a table-board of the washing machine is provided with a first recess capable of horizontally placing the intelligent terminal, and the shape of the first recess is matched with that of the intelligent terminal; and preferably, each of two side walls with larger side lengths is provided with an elastic element for fixing the intelligent terminal.

Further, the table-board of the washing machine is provided with a second recess capable of vertically placing the intelligent terminal, and the shape of the second recess is matched with that of the intelligent terminal; and the bottom of the second recess is provided with two V-shaped brackets for supporting and fixing the intelligent terminal.

Further, the connecting part is arranged in the middle of the two V-shaped brackets and is in insertion connection with the intelligent terminal.

The present disclosure further provides a control method for the washing machine, and the control method comprises:

S1: monitoring a behavior of a user in real time by the intelligent terminal, and inquiring a functional configuration table of the washing machine when monitoring an operation of the user;

S2: analyzing the functional configuration table by the intelligent terminal;

S3: converting the operation of the user into an operation instruction receivable for the washing machine by the intelligent terminal according to a requirement of the functional configuration table, and sending the operation instruction to the washing machine; and S4: receiving the operation instruction by the washing machine, and after executing analysis, executing washing according to the operation instruction.

Further, after the step S1, the control method further comprises: judging whether the functional configuration table is successfully inquired or not by the intelligent terminal, if yes, entering the step S2, and if not, reminding the user of abnormality of a current connection device;

after the step S2, the control method further comprises: judging whether the functional configuration table is successfully analyzed or not by the intelligent terminal, if yes, entering step the S3, and if not, reminding the user of failure in analyzing the current functional configuration table; and after the step S3, the control method further comprises: judging whether the operation instruction is successfully received by the washing machine or not by the intelligent terminal, if yes, entering the step S4, and if not, reminding the user that the washing machine fails in receiving the instruction.

Further, after analyzing the operation instruction by the washing machine in the step S4, the control method further comprises:

judging whether analysis is successful or not by the washing machine;

if yes, executing washing according to the operation instruction; and if not, reminding the user of abnormality of the received instruction.

The technical solution provided by the specific implementation of the present disclosure has the beneficial effects that:

Firstly, the control panel of the washing machine provided by the present disclosure is not provided with the washing program control buttons, the display screen as well as the peripheral circuits for driving the display screen and the washing program control buttons, so that not only is the washing machine simple and generous in appearance, but also the production cost as well as the research and development costs of the washing machine are greatly reduced, and it is beneficial to the popularization of the washing machine.

Secondly, the washing machine is provided with the media interface by which the intelligent terminal is connected, the washing machine is controlled by the intelligent terminal. Nowadays, with the rapid development of the intelligent terminal, every person owns the intelligent terminal, the control center of the intelligent terminal is used as the control center of the washing machine, and the display screen of the intelligent terminal is used as a display module of the washing machine, so that the cost of the washing machine is further reduced on the basis that functions of the washing machine are achieved, and the intelligent terminal is convenient to dismount, flexible in replacement and capable of greatly improving the washing experience of the user.

Thirdly, the media interface arranged on the washing machine can also be directly connected with a PC or a debugging device to conveniently realize system updating or function debugging of the washing machine, so that the problem that functions of a traditional washing machine cannot be updated in time is solved.

Fourthly, the washing machine is further provided with the recess for placing the intelligent terminal, the intelligent terminal is fixedly arranged on the washing machine, so that the intelligent terminal and the washing machine are integrated to provide convenience for the operation of the user on the intelligent terminal.

Fifthly, the function of the start/pause button on the traditional washing machine is changed, and the washing program defaulted to be started by the start/pause button is diversified and can be set in advance in the intelligent terminal by the user when the washing machine is not connected with the intelligent terminal, so that the humanized setting of the washing machine is improved, and the experience of the user is improved.

Sixthly, the process of connecting the washing machine and the intelligent terminal is intelligent, the user is reminded when a plurality of connections fail, and failure reasons are displayed so as to be conveniently inquired by the user.

BRIEF DESCRIPTION OF THE DRAWINGS

In order to more clearly describe technical solutions in specific implementations of the present disclosure, drawings required to be used in the specific implementations are simply introduced below, obviously, the drawings described below are merely some embodiments of the present disclosure, and other drawings can be further achieved by the ordinary skilled in the art on the premise that no creative labors are employed.

Brief description of the drawings: 1—control panel, 2—table-board, 3—media interface, 4—first recess, 5—second recess, 6—elastic element, 7—bracket.

DETAILED DESCRIPTION

Embodiment 1

Figure 1:
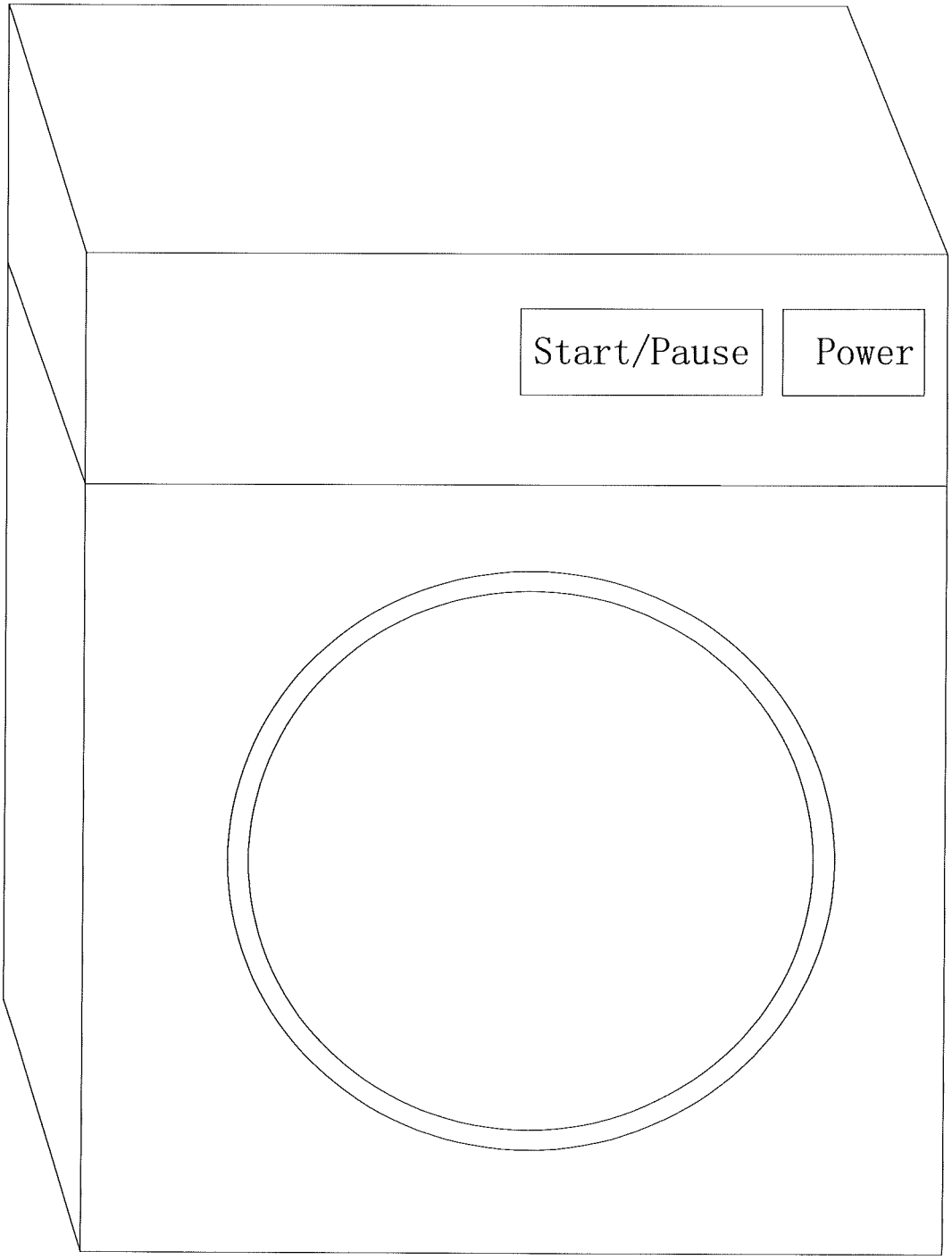
FIG. 1 is a structural schematic diagram of a washing machine provided in an embodiment 1 of the present disclosure.

The embodiment provides a washing machine, as shown in FIG. 1, the washing machine is provided with a control panel 1. The control panel 1 is of a panel structure which is not provided with washing program control buttons, a display screen as well as peripheral circuits for driving the display screen and the washing program control buttons. The washing machine is further provided with a connecting part of an intelligent terminal, and the connecting part can be in data connection with the intelligent terminal and can be used for controlling the washing machine by the intelligent terminal.

The intelligent terminal can be provided with an application program for controlling the washing machine, and a user can enter the application program of the intelligent terminal to control the washing machine after the washing machine is successfully connected with the intelligent terminal.

A control panel on a traditional washing machine has a main effect of realizing human-computer interaction and generally comprises various functional input buttons, a display screen as well as peripheral circuits for driving the display screen and functional buttons, the user can control the washing machine to realize corresponding functions by pressing the corresponding functional input buttons. The current state of the washing machine is fed back through a display window or the display screen, the control panel provided with a touch screen (such as a TFT touch screen) not only can provide an input function, but also can display the current feedback state of the washing machine so as to meet requirements of most of intelligent washing machines for input, such as configuration of networking modules and help for program use. Moreover, realizable functions of the control panel provided with the functional buttons are fewer, the production cost of the touch screen capable of achieving multifunction is higher, great production cost and labor cost can be brought by developing and maintaining the peripheral circuits. Therefore, in order to reduce the costs and not influence the use of the intelligent functions of the washing machine, the control panel 1 is not provided with washing program control buttons, the display screen as well as peripheral circuits for driving the display screen and the washing program control buttons, but the connecting part of the washing machine is connected with the intelligent terminal. The washing machine is controlled by virtue of the display screen of the intelligent terminal and a control center, so that not only is the washing machine simple and generous in appearance, but also the production cost as well as the research and development costs of the washing machine are greatly reduced, and it is beneficial to the popularization of the washing machine.

Further, the connecting part is a media interface 3 which is connected with a serial interface in the washing machine by a chip for converting the serial interface into the media interface, and the chip for converting the serial interface into the media interface is arranged in a mainboard circuit of the washing machine. Preferably, the media interface 3 is a data transmission interface and comprises a USB interface and/or a miniUSB interface.

The serial interface in the traditional washing machine is a reserved interface and is generally used for debugging and upgrading in a development process, but is not used as an external interface. The data transmission interface on the intelligent terminal is generally a USB interface or a miniUSB interface, the serial interface and the USB interface/the miniUSB interface are different in followed protocols so as not to be directly connected, the protocols are required to be converted by using the chip for converting the serial interface into the media interface. A USB and a miniUSB are same in followed protocols so as to be connected directly or by a data line; and therefore, the washing machine can be provided with the media interface 3 (comprising the USB interface and/or the miniUSB interface) which can be connected with the intelligent terminal by the data line, and the chip for converting the serial interface into the media interface is additionally arranged between the media interface 3 and the serial interface inside the washing machine to convert the protocols, so that the data communication between the media interface 3 and the serial interface is realized.

After the mainboard circuit of the washing machine is additionally provided with the chip for converting the serial interface into the media interface, a coded packet in communication with the intelligent terminal is further required to be defined in order to make the washing machine and the intelligent terminal mutually appoint a content to be transmitted. When the coded packet is defined, the functions to be achieved can be defined firstly, and then, transmission names and parameters can be appointed according to contents of the functions. In addition, the intelligent terminal requires an intelligent operating system with super administrator rights, the intelligent operating system can be internally provided with a drive of the chip for converting the serial interface into the media interface, and serving as a main control device, the intelligent terminal is further required to be provided with the application program capable of controlling the washing machine.

As a preferred way of the present disclosure, the connecting part is the serial interface on the washing machine and is connected with a control circuit in the washing machine, the serial interface is set as an external interface and is connected with an audio interface on the intelligent terminal via the data line; and the intelligent terminal is internally provided with an application program capable of controlling the washing machine, the user can realize operation in the application program. The intelligent terminal converts the operation of the user into a corresponding control command which is sent to the serial interface of the washing machine by the audio interface and is then sent to the control circuit of the washing machine, and the control circuit drives a corresponding execution mechanism to execute the command according to the control command sent by the intelligent terminal.

As the other preferred way of the present disclosure, the connecting part is a NFC chip on the washing machine and realizes data exchange with the intelligent terminal by using an NFC technology; and the intelligent terminal is internally provided with an application program capable of controlling the washing machine, the user can realize operation in the application program. The intelligent terminal converts the operation of the user into a corresponding control command which is sent to the washing machine by using the NFC technology, and the control command is received by the washing machine and is sent to a corresponding execution mechanism so as to be executed after being analyzed.

For the popularization of the intelligent terminal at present, every person owns one and even two and three intelligent terminals, and most of the intelligent terminals are provided with tough screens, so that the way of controlling the washing machine by using the intelligent terminal is not only convenient, but also capable of realizing touch control operation. In addition, the feedback state of the washing machine is further displayed on a display interface of the intelligent terminal, and the intelligent terminal is convenient to dismount, flexible in replacement and capable of greatly improving the washing experience of the user. The media interface 3 arranged on the washing machine is directly connected with a PC or a debugging device to conveniently realize system updating or function debugging of the washing machine, so that the trouble that functions of a traditional washing machine cannot be updated in time is solved.

Further, the control panel 1 is provided with a power button and a start/pause button, the power button is used for controlling the start/stop of the washing machine; and the functions of the start/pause button include the two conditions as follows:

(1) After the washing machine is connected with the intelligent terminal, a washing program is selected on the intelligent terminal, the intelligent terminal transmits the selected washing program to the washing machine, the start/pause button is pressed at the moment to start the currently-selected washing program, and the start/pause button is pressed in an operation process of the washing process to pause or further operate the current washing program.

(2) When the washing machine is not connected with the intelligent terminal, the user can directly control the washing machine to execute the program, and the specific method comprises: pressing the start/pause button to default to start a certain washing program, and pressing the start/pause button in the operation process of the washing program to pause or further operate the current washing program. Wherein the washing program which is defaulted to be started by the start/pause button is:

a. A washing program defaulted in the washing machine.

Wherein the washing program can be preset in a mainboard of the washing machine by a developer.

b. A washing program preset by the intelligent terminal.

Wherein the washing program is actively set in the application program of the intelligent terminal after the washing machine is connected with the intelligent terminal, and the washing program is transmitted to the washing machine by the intelligent terminal so as to be stored after the setting is finished.

c. A historical washing program most frequently executed by the washing machine.

Wherein the washing machine has a memory function for the washing program operated every time and can calculate the total operation number of times of each washing program and compare and calculate the washing program most frequently executed by the washing machine.

d. A washing program executed by the washing machine for the last time.

Wherein the washing machine has a memory function for the washing program operated every time and stores the washing program operating this time as the washing program executed by the washing machine for the last time after the operation of the washing program is ended.

Compared with the start/pause button of the traditional washing machine, which has a single function, the start/pause button of the washing machine in the present disclosure can be debugged in time according to the demand of the user or a market, so that it is more beneficial to the meeting of the demands of consumers, meanwhile, the humanized setting of the washing machine is further improved, and the experience of the user is improved.

Figure 2:
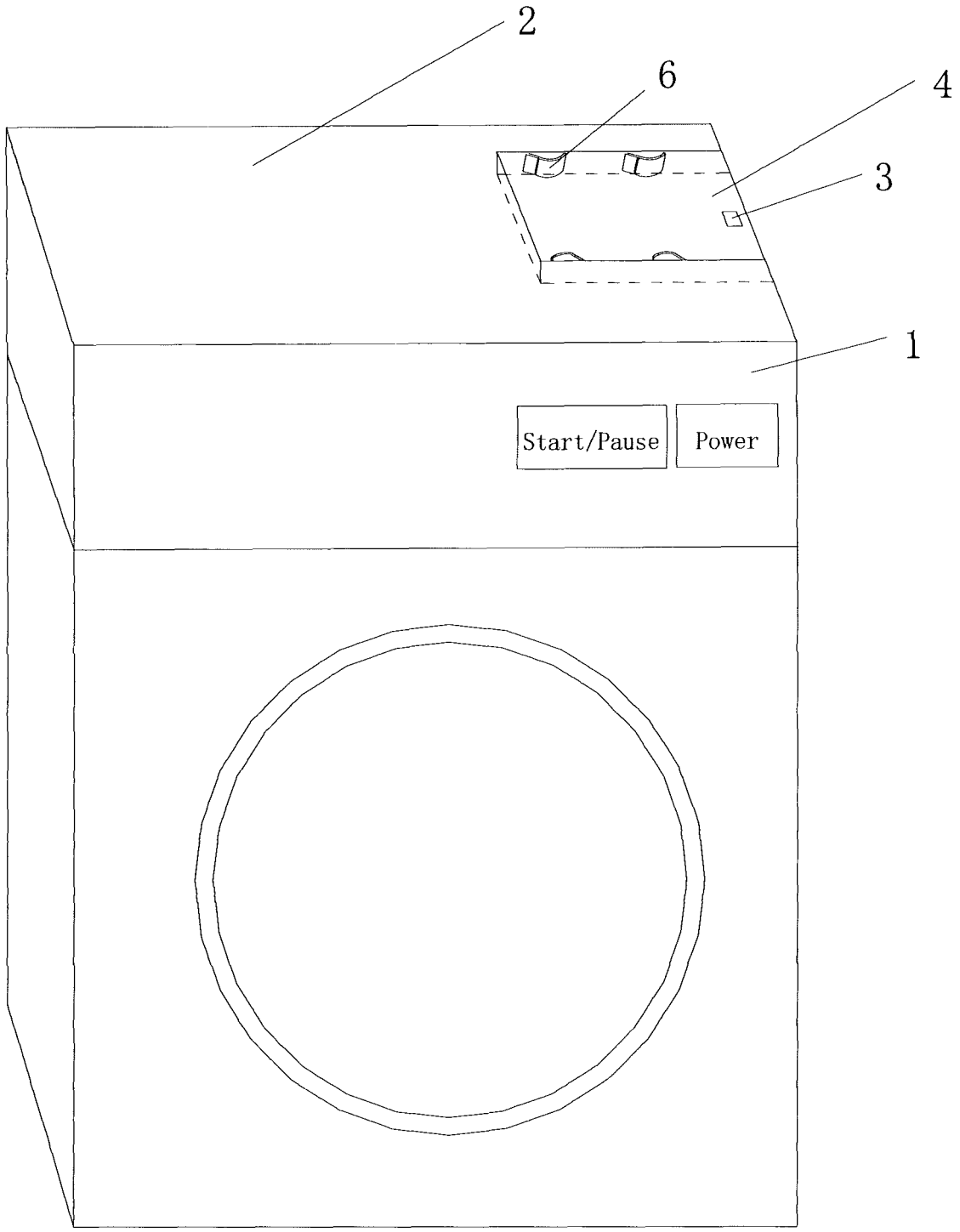
FIG. 2 is a structural schematic diagram of another washing machine provided in the embodiment 1 of the present disclosure.

Further, as shown in FIG. 2, a table-board 2 of the washing machine is provided with a first recess 4 capable of horizontally placing the intelligent terminal, the shape of the first recess 4 is matched with that of the intelligent terminal, and preferably, each of two side walls with larger side lengths is provided with an elastic element 6 for fixing the intelligent terminal. After the intelligent terminal is connected with the washing machine, the intelligent terminal is fixedly arranged in the recess and used as the control panel and the display screen of the washing machine, the user can realize touch control operation on the intelligent terminal, and therefore, the operation is simple and convenient.

The first recess 4 is close to the edge of the table-board 2 and is further provided with an opening at the side with a smaller side length so as to facilitate connecting the intelligent terminal with the washing machine by using the data line, and preferably, the media interface 3 (namely the connecting part) on the washing machine is arranged in the first recess 4. Wherein the elastic element 6 is a plastic sheet with elasticity, the elastic elements 6 on the two side walls are oppositely arranged and are protruded towards the respective opposite sides, and preferably, the protruded parts of the elastic elements 6 are also provided with outwards-inclined slopes, so that it is convenient to vertically press the intelligent terminal into the recess and realize the operation of the user on the intelligent terminal.

Figure 3:
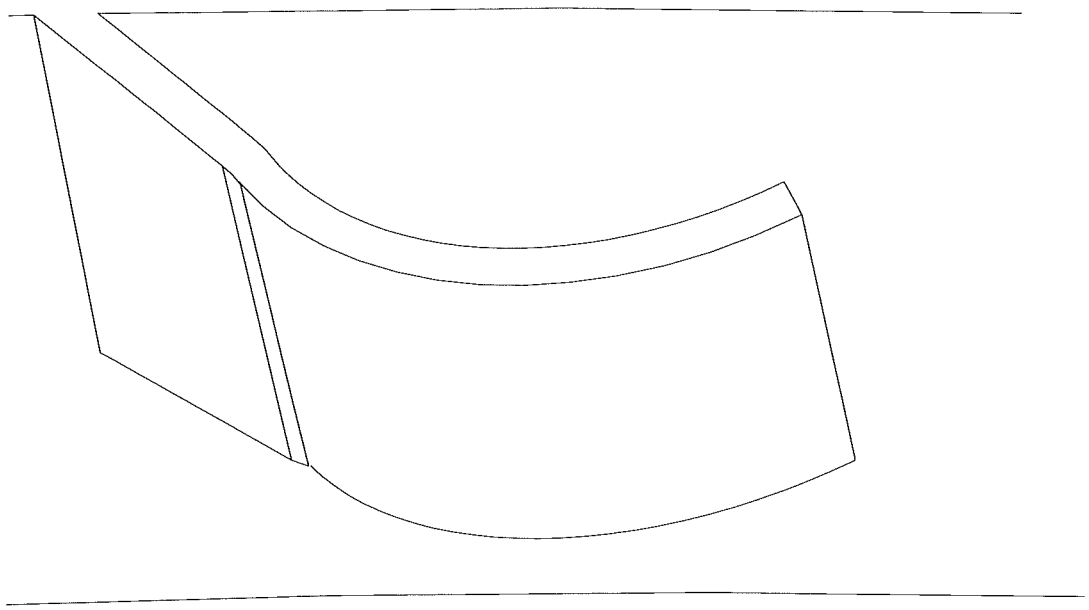
FIG. 3 is a structural schematic diagram of an elastic element provided in the embodiment 1 of the present disclosure.

Preferably, the arrangement of the elastic elements 6 are shown as FIG. 3, two ends of the elastic elements 6 are fixedly arranged on the side walls of the first recess 4, and the side walls of the first recess 4 are provided with at least one elastic element 6.

Figure 4:
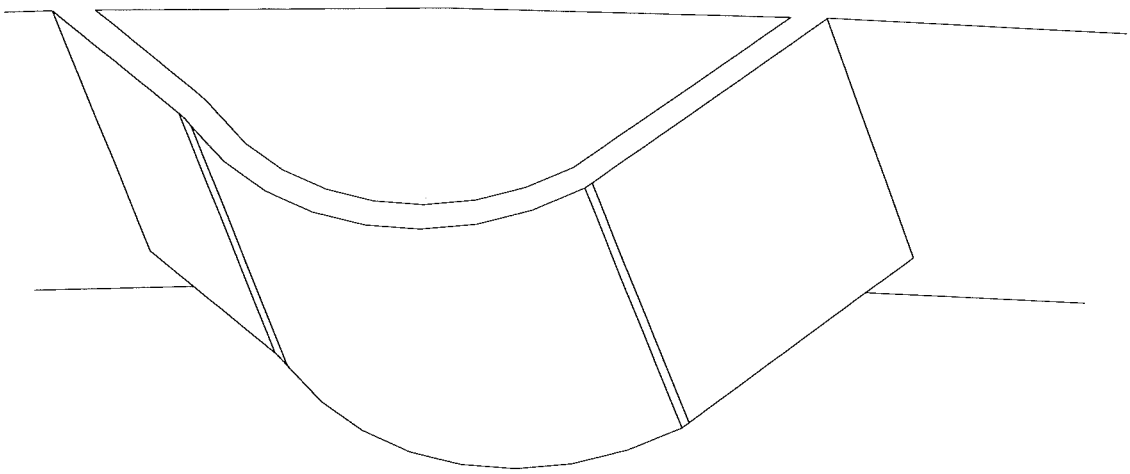
FIG. 4 is a structural schematic diagram of another elastic element provided in the embodiment 1 of the present disclosure.

Preferably, the arrangement of the elastic elements 6 are shown as FIG. 4, one end of each elastic element 6 is fixedly arranged on the side wall of the first recess 4, the other end of each elastic element 6 is a free end, and the side walls of the first recess 4 are provided with at least one elastic element 6.

Figure 5:
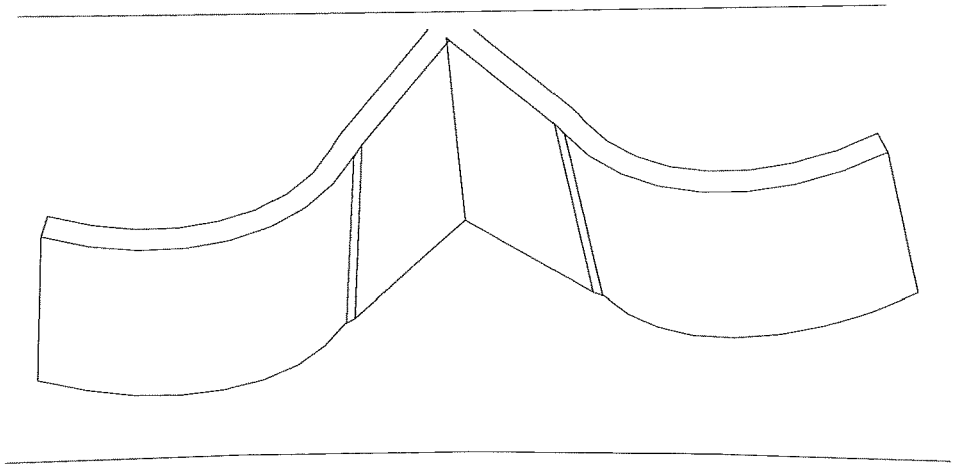
FIG. 5 is a structural schematic diagram of another elastic element provided in the embodiment 1 of the present disclosure.

Preferably, the arrangement of the elastic elements 6 are shown as FIG. 5, one end of each elastic element 6 is fixedly arranged on the side wall of the first recess 4, the other end of each elastic element 6 is a free end, the two elastic elements 6 located on the same side wall form a group and are matched to be used to form a herringbone, and the side walls of the first recess 4 are provided with at least one group of herringbone elastic elements 6, and preferably, the herringbone elastic elements 6 on the side walls at two opposite sides are oppositely arranged and are matched to be used.

Figure 6:
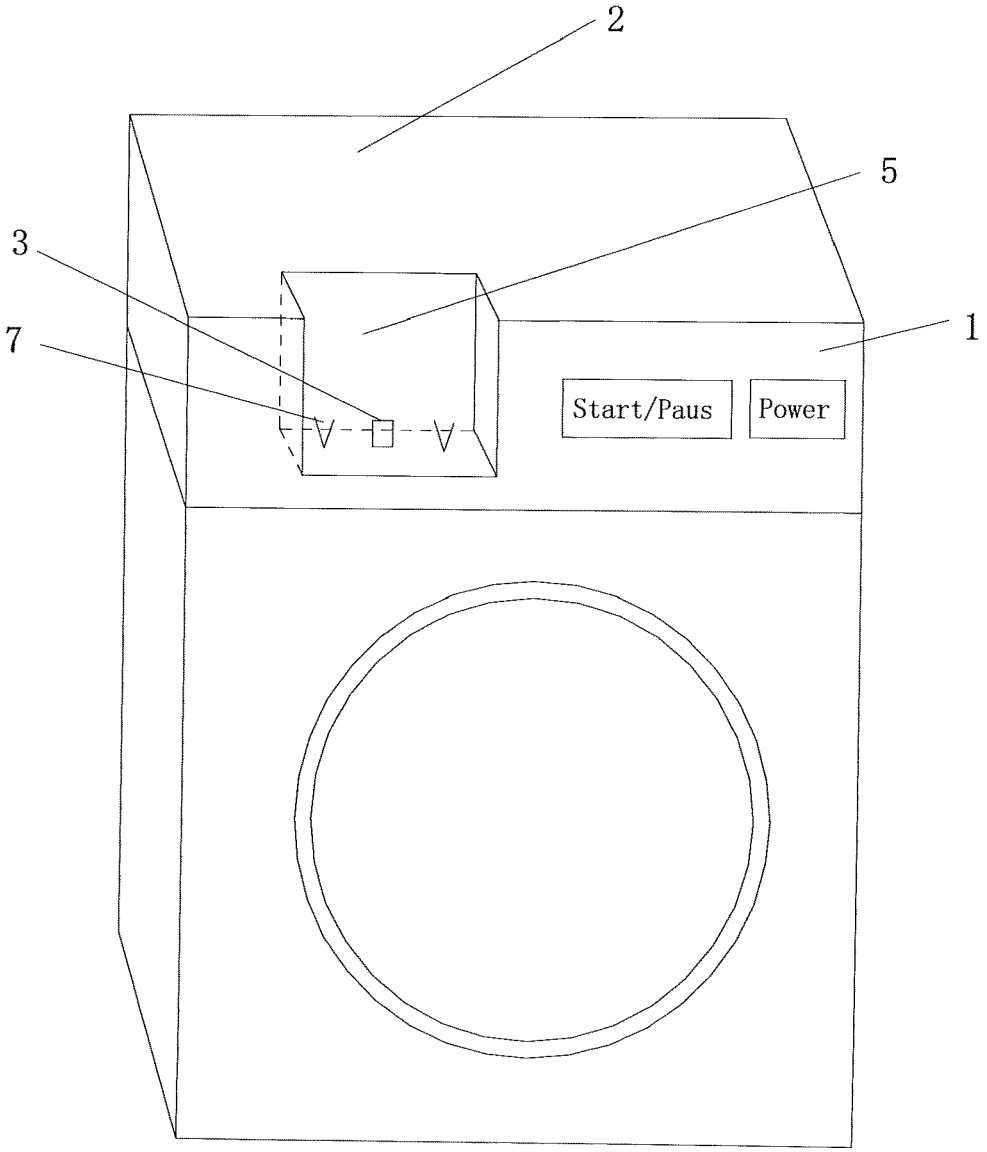
FIG. 6 is a structural schematic diagram of another washing machine provided in the embodiment 1 of the present disclosure.

As the other preferred way of the present disclosure, as shown in FIG. 6, the table-board 2 of the washing machine is provided with a second recess 5 capable of vertically placing the intelligent terminal, the shape of the second recess 5 is matched with that of the intelligent terminal, and the bottom of the second recess 5 is provided with two V-shaped brackets 7 for supporting and fixing the intelligent terminal, so that the intelligent terminal is convenient to operate for the user.

Preferably, the connecting part is arranged in the middle of the two V-shaped brackets 7 to form a straight line with the two V-shaped brackets 7 and is in insertion connection with the intelligent terminal. Further, preferably, the connecting part is a miniUSB plug and is connected with the serial interface on the mainboard of the washing machine by the chip for converting the serial interface into the media interface. When the intelligent terminal is connected with the washing machine, the miniUSB interface of the intelligent terminal is aligned to the miniUSB plug on the washing machine, the intelligent terminal is pressed down from top to bottom and is supported and fixed by the two V-shaped brackets 7, the miniUSB interface of the intelligent terminal is directly spliced with the miniUSB plug on the washing machine, and the data line is not needed any more.

Embodiment 2

Figure 7:
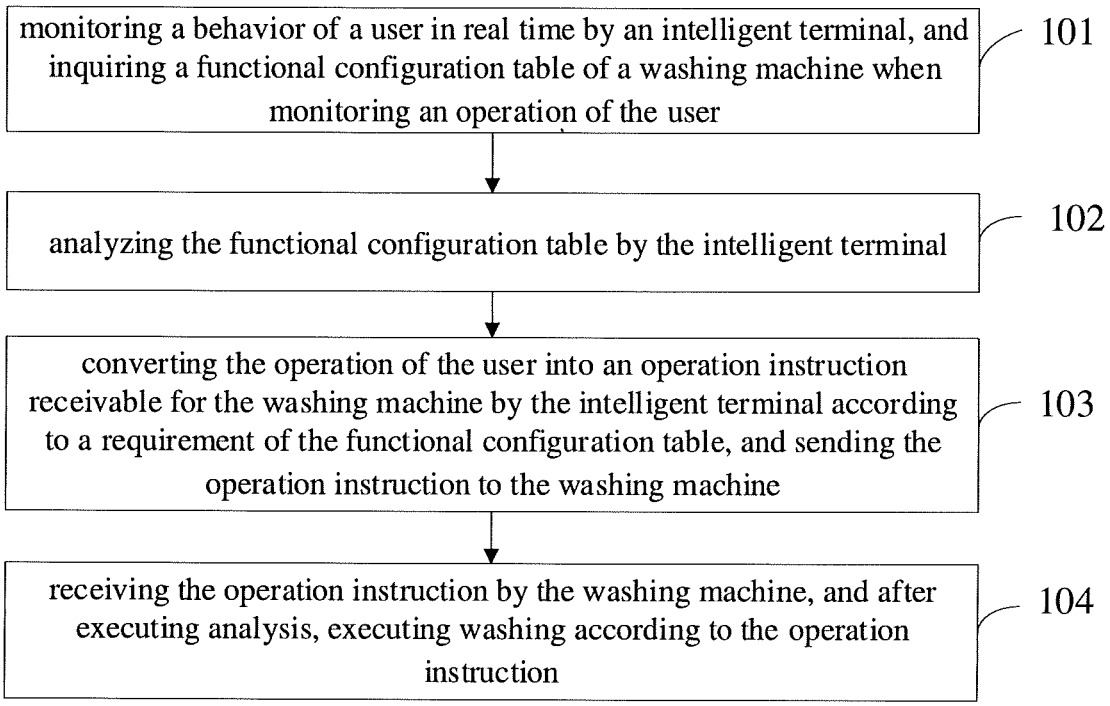
FIG. 7 is a flow diagram of a control method of the washing machine provided in an embodiment 2 of the present disclosure.

The embodiment provides a control method for the washing machine, the intelligent terminal is provided with an application program capable of controlling the washing machine, and the intelligent terminal can control the washing machine after the washing machine is in wired connection or in direct insertion connection with the intelligent terminal, as shown in FIG. 7, the method comprises:

step 101: monitoring a behavior of a user in real time by the intelligent terminal, and inquiring a functional configuration table of the washing machine when monitoring an operation of the user;

step 102: analyzing the functional configuration table by the intelligent terminal;

step 103: converting the operation of the user into an operation instruction receivable for the washing machine by the intelligent terminal according to a requirement of the functional configuration table, and sending the operation instruction to the washing machine; and step 104: receiving the operation instruction by the washing machine, and after executing analysis, executing washing according to the operation instruction.

Embodiment 3

Figure 8:
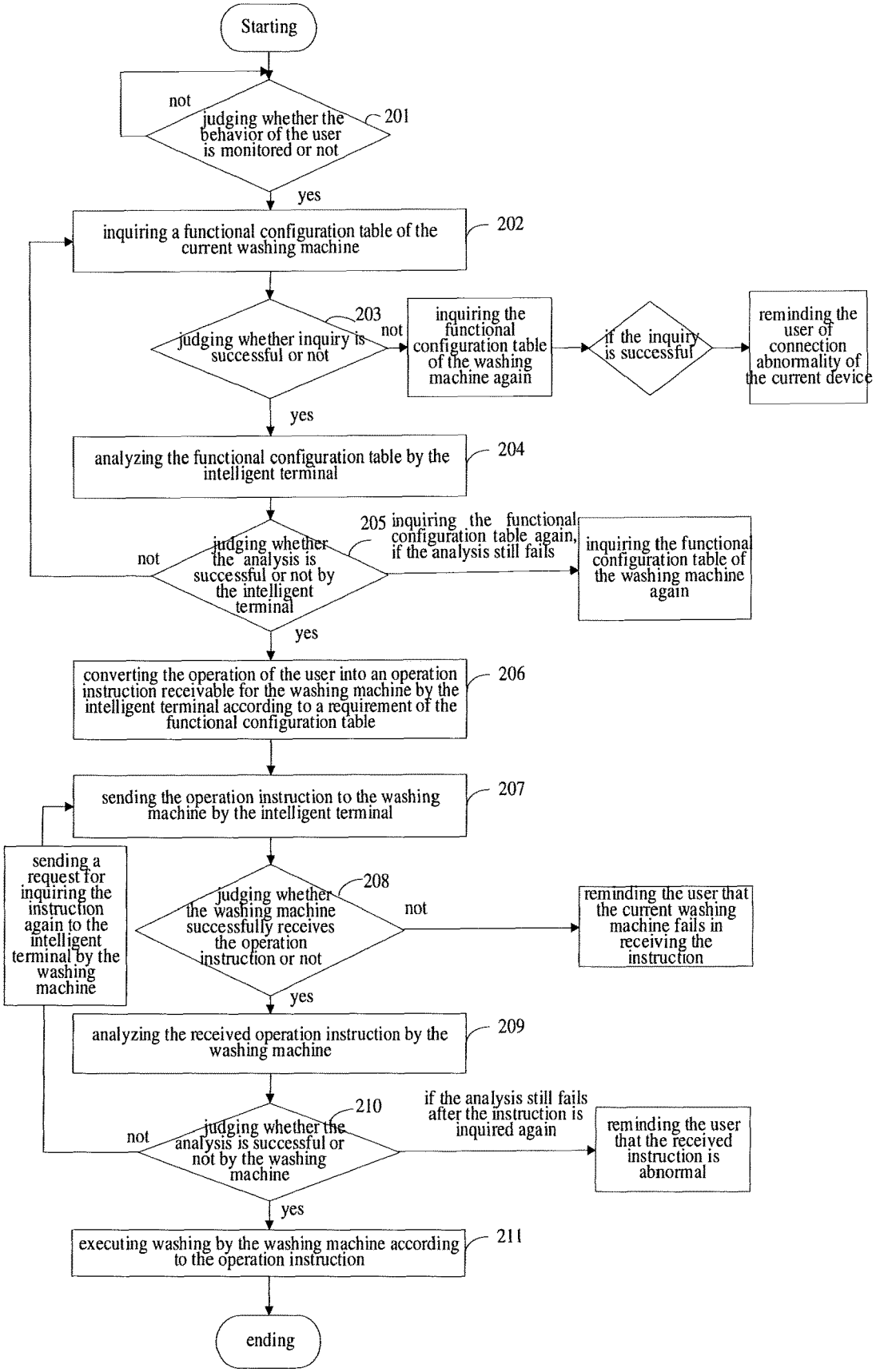
FIG. 8 is a flow diagram of the other control method of the washing machine provided in an embodiment 3 of the present disclosure.

The embodiment provides a control method for the washing machine, the intelligent terminal is provided with an application program capable of controlling the washing machine, and the intelligent terminal can enter the application program to control the washing machine after the washing machine is in wired connection or in direct insertion connection with the intelligent terminal, as shown in FIG. 8, the control method comprises:

Step 201: judging whether a behavior of a user is monitored or not.

Specifically, the intelligent terminal monitors the behavior of the user in real time and judges whether the behavior of the user is monitored or not, if yes, step 202 is entered; and if not, step 201 is repeated.

The behavior of the user is an operation of the user on the intelligent terminal, for example, the user presses down a certain key of a mobile phone, the user performs input on the touch screen, or the user performs voice input, and the intelligent terminal determines that the behavior of the user is monitored when the operation of the user happens.

Step 202: inquiring a functional configuration table of the current washing machine.

Specifically, the intelligent terminal inquires the functional configuration table of the current washing machine when monitors the operation of the user.

The functional configuration table of the washing machine is preset in the washing machine and records contents such as an identification (such as a special number of the mainboard) of the current washing machine, a function list supported by the current washing machine and relevant parameters. The intelligent terminal can control a plurality of washing machines, and different types of washing machines have different functions and transmission protocols. Before controlling the washing machine, the intelligent terminal needs to identify the type of the washing machine, an instruction receivable for the washing machine, a control way and the like, so that the functional configuration table of the current washing machine is required to be inquired.

Step 203: judging whether the functional configuration table is successfully inquired or not;

if yes, entering step 204; and if not, further inquiring the functional configuration table.

The intelligent terminal determines that the functional configuration table is successfully inquired if the washing machine can transmit the functional configuration table to the intelligent terminal. And the intelligent terminal possibly fails in inquiring the functional configuration table if the connection of the intelligent terminal and the washing machine is unstable or the washing machine/the intelligent terminal is abnormal.

Specifically, the intelligent terminal automatically tries to inquire the functional configuration table for the second time when the intelligent terminal fails in inquiring the functional configuration table for the first time. Step 204 is entered if the inquiry is successful, the user is reminded that a current connection device is abnormal if the inquiry still fails, and the user can check whether the washing machine or the intelligent terminal is abnormal or the data line for connecting the washing machine with the intelligent terminal is abnormal according to a hint.

Step 204: analyzing the functional configuration table by the intelligent terminal.

The configuration table is substantially a string of codes during transmission, and the content in the functional configuration table is explained according to the illustration of the coded packet after the intelligent terminal acquires the codes through the serial interface.

Step 205: judging whether analysis is successful or not;

if yes, entering step 206; and if not, returning to step 202, and requiring the functional configuration table of the washing machine again.

Specifically, when the intelligent terminal fails in analyzing the functional configuration table for the first time, the intelligent terminal automatically inquires the functional configuration table of the current washing machine again and analyzes the functional configuration table. Step 206 is entered if the analysis is successful, and the user is reminded that the analysis of the current functional configuration table fails if the analysis still fails, and the user can check whether the washing machine or the intelligent terminal is abnormal or the data line for connecting the washing machine with the intelligent terminal is abnormal according to a hint.

Step 206: converting the operation of the user into an operation instruction receivable for the washing machine by the intelligent terminal according to a requirement of the functional configuration table.

Specifically, the operation instruction receivable for the washing machine and corresponding to the operation of the user can be found according to a preset corresponding relation in the configuration table after the intelligent terminal successfully realizes analysis.

Step 207: sending the operation instruction to the washing machine by the intelligent terminal.

Step 208: judging whether the washing machine successfully receives the operation instruction or not;

if yes, executing step 209; and if not, reminding the user that the washing machine fails in receiving the instruction.

Specifically, after receiving the operation instruction sent by the intelligent terminal, the washing machine is required to send a feedback signal to the intelligent terminal to explain that the washing machine successfully receives the operation instruction, it shows that the washing machine successfully receives the instruction if the intelligent terminal receives the feedback signal sent by the washing machine within a preset time (such as 30*s*), and the intelligent terminal determines that the current washing machine fails in receiving the instruction if the intelligent terminal does not receive the feedback signal sent by the washing machine within the preset time.

Step 209: analyzing the received operation instruction by the washing machine.

The operation instruction sent by the intelligent terminal is substantially a string of codes, and the washing machine can control corresponding execution mechanisms to execute the operation instruction by analyzing the string of codes after receiving the string of codes.

Step 210: judging whether the analysis is successful or not by the washing machine; if yes, entering step 211, and if not, sending a request for inquiring the instruction again to the intelligent terminal.

Specifically, the washing machine sends the request for inquiring the instruction again to the intelligent terminal when the washing machine fails in analyzing the instruction for the first time, the intelligent terminal resends an operation instruction corresponding to the operation of the user to the washing machine after receiving the request, the washing machine receives and analyzes the operation instruction, and the user is reminded that the received instruction is abnormal if the analysis still fails.

Step 211: executing washing by the washing machine according to the operation instruction.

The above description should not be construed as limitations of the present disclosure in any ways, but merely as preferred embodiments thereof, the preferred embodiments has been disclosed as above, but are not intended to limit the present disclosure, few alterations or modifications can be made by any skilled in the patent by utilizing the prompted technical content without departing from the scope of the technical solution of the present disclosure to achieve equivalent embodiments with equivalent variations, and any simple amendments, equivalent variations and modifications, made according to a technical essence without departing from the technical solution of the present disclosure, on the embodiments still fall into the scope of the solution of the present disclosure.

The invention claimed is:

1. A washing machine comprising a control panel, wherein the washing machine is further provided with a connecting part for an intelligent terminal, the connecting part is in data connection with the intelligent terminal and the washing machine is controlled by the intelligent terminal, and the control panel is of a panel structure which is not provided with a washing program control button, a display screen as well as a peripheral circuit for driving the display screen and the washing program control button, the connecting part is a media interface connected with a serial interface in the washing machine by a chip for converting the serial interface into the media interface;

and the chip for converting the serial interface into the media interface is arranged in a mainboard circuit of the washing machine.

2. The washing machine according to claim 1, wherein the media interface comprises a USB interface and/or a miniUSB interface.

3. The washing machine according to claim 1, wherein the control panel is provided with a power button and a start/pause button;

when the washing machine is not connected with the intelligent terminal, a washing program which is defaulted to be started by the start/pause button is:

a washing program defaulted in the washing machine; or a washing program preset by the intelligent terminal; or a historical washing program most frequently executed by the washing machine; or a washing program executed by the washing machine for a last time.

4. The washing machine according to claim 1, wherein a table-board of the washing machine is provided with a first recess configured to horizontally place the intelligent terminal, and a shape of the first recess is matched with that of the intelligent terminal.

5. The washing machine according to claim 1, wherein a table-board of the washing machine is provided with a second recess configured to vertically place the intelligent terminal, and a shape of the second recess is matched with that of the intelligent terminal; and a bottom of the second recess is provided with two V-shaped brackets for supporting and fixing the intelligent terminal.

6. The washing machine according to claim 5, wherein the connecting part is arranged in a middle of the two V-shaped brackets and is in insertion connection with the intelligent terminal.

7. The washing machine according to claim 4, wherein each of two side walls with larger side lengths is provided with an elastic element for fixing the intelligent terminal.

8. A control method for the washing machine according to claim 1, the method comprising:

S1: monitoring a behavior of a user in real time by the intelligent terminal, and inquiring a functional configuration table of the washing machine when monitoring an operation of the user;

S2: analyzing the functional configuration table by the intelligent terminal;

S3: converting the operation of the user into an operation instruction receivable for the washing machine by the intelligent terminal according to a requirement of the functional configuration table, and sending the operation instruction to the washing machine; and S4: receiving the operation instruction by the washing machine, and executing washing according to the operation instruction after executing analysis.

9. The control method according to claim 8, further comprising:

after the step S1, judging whether the functional configuration table is successfully inquired or not by the intelligent terminal, if yes, entering the step S2, and if not, reminding the user of abnormality of a current connection device;

after the step S2, the control method further comprising:

judging whether the functional configuration table is successfully analyzed or not by the intelligent terminal, if yes, entering the step S3, and if not, reminding the user of failure in analyzing the current functional configuration table; and after the step S3, the control method further comprising:

judging whether the operation instruction is successfully received by the washing machine or not by the intelligent terminal, if yes, entering the step S4, and if not, reminding the user that the washing machine fails in receiving the instruction.

10. The control method according to claim 9, further comprising:

after analyzing the operation instruction by the washing machine in the step S4, judging whether the analysis is successful or not by the washing machine;

if yes, executing washing according to the operation instruction; and if not, reminding the user of abnormality of the received instruction.

11. A control method for the washing machine according to claim 2, the method comprising:

S1: monitoring a behavior of a user in real time by the intelligent terminal, and inquiring a functional configuration table of the washing machine when monitoring an operation of the user;

S2: analyzing the functional configuration table by the intelligent terminal;

S3: converting the operation of the user into an operation instruction receivable for the washing machine by the intelligent terminal according to a requirement of the functional configuration table, and sending the operation instruction to the washing machine; and S4: receiving the operation instruction by the washing machine, and executing washing according to the operation instruction after executing analysis.

12. A control method for the washing machine according to claim 3, the method comprising:

S1: monitoring a behavior of a user in real time by the intelligent terminal, and inquiring a functional configuration table of the washing machine when monitoring an operation of the user;

S2: analyzing the functional configuration table by the intelligent terminal;

S3: converting the operation of the user into an operation instruction receivable for the washing machine by the intelligent terminal according to a requirement of the functional configuration table, and sending the operation instruction to the washing machine; and S4: receiving the operation instruction by the washing machine, and executing washing according to the operation instruction after executing analysis.

* * * * *